US009683797B2

(12) United States Patent
Boyarkin

(10) Patent No.: US 9,683,797 B2
(45) Date of Patent: Jun. 20, 2017

(54) DEVICE FOR UNIVERSAL CHARGING AND METERING FOR CARTRIDGES IN BOX MAGAZINES

(71) Applicant: Vitali Vitalevich Boyarkin, Irkutsk (RU)

(72) Inventor: Vitali Vitalevich Boyarkin, Irkutsk (RU)

(73) Assignees: Federal State Budgetary Institution, Fedreal Agency for Legal Protection of Military, Special and Dual Use Intellectual Activity Results (FSBI-FALPIAR), Moscow (RU); Vitali Vitalevich Boyarkin, Irkutsk (RU)

( * ) Notice: Subject to any disclaimer, the term of this patent is extended or adjusted under 35 U.S.C. 154(b) by 152 days.

(21) Appl. No.: 14/394,189

(22) PCT Filed: Sep. 28, 2012

(86) PCT No.: PCT/RU2012/000789

§ 371 (c)(1),
(2) Date: Oct. 13, 2014

(87) PCT Pub. No.: WO2013/154455

PCT Pub. Date: Oct. 17, 2013

(65) Prior Publication Data

US 2015/0075052 A1 Mar. 19, 2015

(30) Foreign Application Priority Data

Apr. 11, 2012 (RU) ..... 2012114396

(51) Int. Cl.

| | |
|---|---|
| ***F41A 9/66*** | (2006.01) |
| ***F41A 9/62*** | (2006.01) |
| ***F41A 9/67*** | (2006.01) |

(52) U.S. Cl.
CPC *F41A 9/66* (2013.01); *F41A 9/62* (2013.01); *F41A 9/67* (2013.01)

(58) Field of Classification Search
CPC ..... F41A 9/61–9/62; F41A 9/65–9/67; F41A 9/82–9/83

(Continued)

(56) References Cited

U.S. PATENT DOCUMENTS 382,455 A 5/1888 Butler
982,618 A * 1/1911 Maple et al. ..... 42/6

(Continued)

FOREIGN PATENT DOCUMENTS

WO WO 2013/154455 10/2013

OTHER PUBLICATIONS

International Search Report Dated Mar. 28, 2013 From the Patent Office of the Russian Federation Re. Application No. PCT/RU2012/000789 and its Translation Into English.

(Continued)

*Primary Examiner* — Stephen M Johnson
*Assistant Examiner* — Benjamin Gomberg
(74) *Attorney, Agent, or Firm* — Andrew W. Chu; Craft Chu PLLC

(57) ABSTRACT

The proposed invention relates to small arms, specifically to charging devices for charging magazines with cartridges and to meters for cartridges in box magazines. The technical result consists in providing a universal charging device and meter for cartridges in box magazines which makes it possible to achieve rapid charging and discharging of cartridges to and from said magazines and visual and tactile monitoring of the number of said cartridges in box magazines which have been withdrawn from and inserted in a weapon. The device has a minimal weight and can easily be (Continued)

built into any box magazine of an automatic machine gun or a pistol having a spring-loaded cartridge feed mechanism.

3 Claims, 3 Drawing Sheets

(58) Field of Classification Search
USPC ..... 42/87, 1.02
See application file for complete search history.

(56) References Cited

U.S. PATENT DOCUMENTS

| | | | | | |
|---|---|---|---|---|---|
| 1,500,580 | A * | 7/1924 | Fererro | F41A 9/67 | 42/50 |
| 1,797,951 | A * | 3/1931 | Gaidos | 42/50 | |
| 2,377,661 | A * | 6/1945 | Baker | F41A 9/62 | 235/98 R |
| 2,569,995 | A * | 10/1951 | Kapsa | F41A 9/62 | 116/298 |
| 3,736,686 | A * | 6/1973 | Moller | F41A 9/83 | 42/50 |
| 4,027,415 | A * | 6/1977 | Stoner | 42/50 | |
| 4,430,821 | A * | 2/1984 | Vincent | 42/50 | |
| 4,688,344 | A * | 8/1987 | Kim | F41A 9/67 | 42/50 |
| 4,831,761 | A * | 5/1989 | Kulakow | F41A 9/67 | 42/50 |
| 5,291,679 | A | 3/1994 | Wollack et al. | | |
| 7,536,816 | B2 * | 5/2009 | Weinberger | 42/1.02 | |
| 8,186,086 | B2 * | 5/2012 | Gur-Ari et al. | 42/1.02 | |
| 9,303,934 | B1 * | 4/2016 | Kazsuk | F41A 9/83 | |
| 2005/0150148 | A1 * | 7/2005 | Herpel | 42/50 | |
| 2005/0188579 | A1 * | 9/2005 | Gates | F41A 9/71 | 42/50 |
| 2011/0167695 | A1 * | 7/2011 | Faifer | F41A 9/67 | 42/50 |
| 2011/0308125 | A1 * | 12/2011 | Gabay et al. | 42/1.02 | |
| 2012/0030987 | A1 | 2/2012 | Lee, III | | |
| 2014/0373415 | A1 * | 12/2014 | Faifer | 42/49.01 | |

OTHER PUBLICATIONS

Zhuk "Entsiklopedia Strelkovogo Oruzhiya [Encyclopedia of Firearms]", Voennoe Izdatelstvo, p. 276, 1999. Figs.13-32.

* cited by examiner

DEVICE FOR UNIVERSAL CHARGING AND METERING FOR CARTRIDGES IN BOX MAGAZINES

RELATED APPLICATIONS

This application is a National Phase of PCT Patent Application No. PCT/RU2012/000789 having International filing date of Sep. 28, 2012, which claims the benefit of priority of Russian Patent Application No. 2012114396 filed on Apr. 11, 2012. The contents of the above applications are all incorporated by reference as if fully set forth herein in their entirety.

FIELD AND BACKGROUND OF THE INVENTION

The proposed invention relates to small arms, in particular to cartridge charging devices and cartridge meters for box magazines.

The Lula_24216 speed loader by Butler Creek company (e-guns(dot)com(dot)ua/product_info(dot)php?products id=316) is known, which is made as a locking attachment placed to an arms magazine neck which upper portion is provided with an hole for loading cartridges into the attachment and a plunger having two cams connected to the handle, said plunger being capable of turning to a certain angle axially. The handle may rotate axially to two extreme positions limited by the attachment housing. While the handle is in each of the extreme positions, one of the cams moves to the lowest position and presses on a cartridge placed in the attachment housing, the cartridge being sunk and fixed in the magazine. Actually, this device makes loading of a magazine easier, acting similarly to the man's fingers, when a magazine is loaded manually.

Drawbacks of this device are the necessity of using it for loading, time losses due to the necessity of its mounting and dismounting to/from a magazine, long time required for placing cartridges one-by-one to the attachment aperture, absence of a meter for loaded cartridges.

Speed loaders for cartridges arranged in clips are known: AK Speed Loader Part#Ldraka01 (China) (http://centerfire-systems (dot)com/ldraka01(dot)aspx): charging device for a clip for a magazine for AK74 (USSR) (popgun(dot)ru/viewtopic(dot)php?f=146&t=8930). In order to use these devices, cartridges, first, are loaded into clips by 10-15 cartridges, then adapters are mounted to magazine necks, loaded clips are inserted into these adapters, and cartridges are pressed along the clip guides by the thumb.

Drawbacks of these systems are the necessity of providing clips and adapters, time losses for loading clips beforehand and for mounting adapters onto magazines, the necessity of applying high forces for pressing cartridges into a magazine, and the absence of a cartridge meter.

A cartridge meter used in CD-MaG magazines by Command Arms company (US), which is manufactured by CAA Tactical company (Israel) and consists of a band with fluorescent figures applied to it and a color scale used for rough estimate of a cartridge number in a magazine, the scale being connected to a follower and having a spring for winding the band onto a drum (e-guns(dot)com(dot)ua/product info(dot)php?cPath=21_24&products id=274).

A drawback of this meter is the absence of the possibility of tactile determination of a number of cartridges left in a magazine and the possibility of ensuring their loading into the magazine.

Electronic meters of ammunition for pistols, as manufactured by Rade Technology company, are known (all-guns (dot)ru/novosti/schechik-boepripasov-ot-rade-technology (dot)html). These devices consist of a sensor in a special magazine and a LED indicator or display for figures, which are arranged on changeable grip side pieces. They have the following drawbacks: the necessity of changing power cells and replacing a standard magazine and standard grip side pieces.

A cartridge meter is known (RU Patent No. 2370718), which operates on the principle of determining a distance between the follower and the magazine base and has magnetically sensitive, or infrared, or ultrasonic distance indicators and a LED display on arms. Drawbacks are: complexity of this device, the necessity of changing power cells, the standard magazine and arms grip side pieces.

A magazine with the indication of a number of cartridges is known (RU Patent No. 2030703), which has apertures on the magazine walls, these apertures being displaced relative to each other along the housing width. Opposite to each aperture, the follower housing is provided with a row of figures corresponding to a number of cartridges read in the corresponding aperture when the follower passes it. This device has the following drawbacks: determination of cartridges in a magazine is complicated in the dark, and tactile determination of cartridges is impossible.

The reviewed sources do not teach any systems of cartridge meters and charging devices that are combined in a single device.

SUMMARY OF THE INVENTION

The objective of the proposed invention is to design a universal charging device and meter (UCM) for box magazines, which enables to load/unload cartridges quickly and monitor their number in a magazine removed from or inserted into arms with the use of one simple and reliable device each arms magazine is provided with.

This task is solved due to the fact that the proposed universal charging device and meter of cartridges for box magazines, which comprises a housing, a follower, a follower spring and a cover, is made in the form of a spring-elastic tie rod composed of a plastic, metal or composite material and provided on its two sides with scales used for determining a number of cartridges in the magazine separated from or inserted into arms; the upper end of the tie rod is connected either to the cartridge follower, or to the upper end of the follower spring, or to an intermediate support located between the follower and the spring; the tie rod is inside the magazine, and its lower end, together with a supporting ring attached to it with the use of a collar, goes out through an hole in the magazine cover with the possibility of moving reciprocally during compression or tensioning of the spring, wherein, when the magazine is emptied completely, the lower end of the tie rod, which is bended by 180 degrees, rests against the cover surface, and the cover is provided with protective projections around the hole through which the tie rod goes out of it.

BRIEF DESCRIPTION OF THE DRAWINGS

The proposed device is illustrated by the following drawings, wherein.

DESCRIPTION OF SPECIFIC EMBODIMENTS OF THE INVENTION

Figure 1:
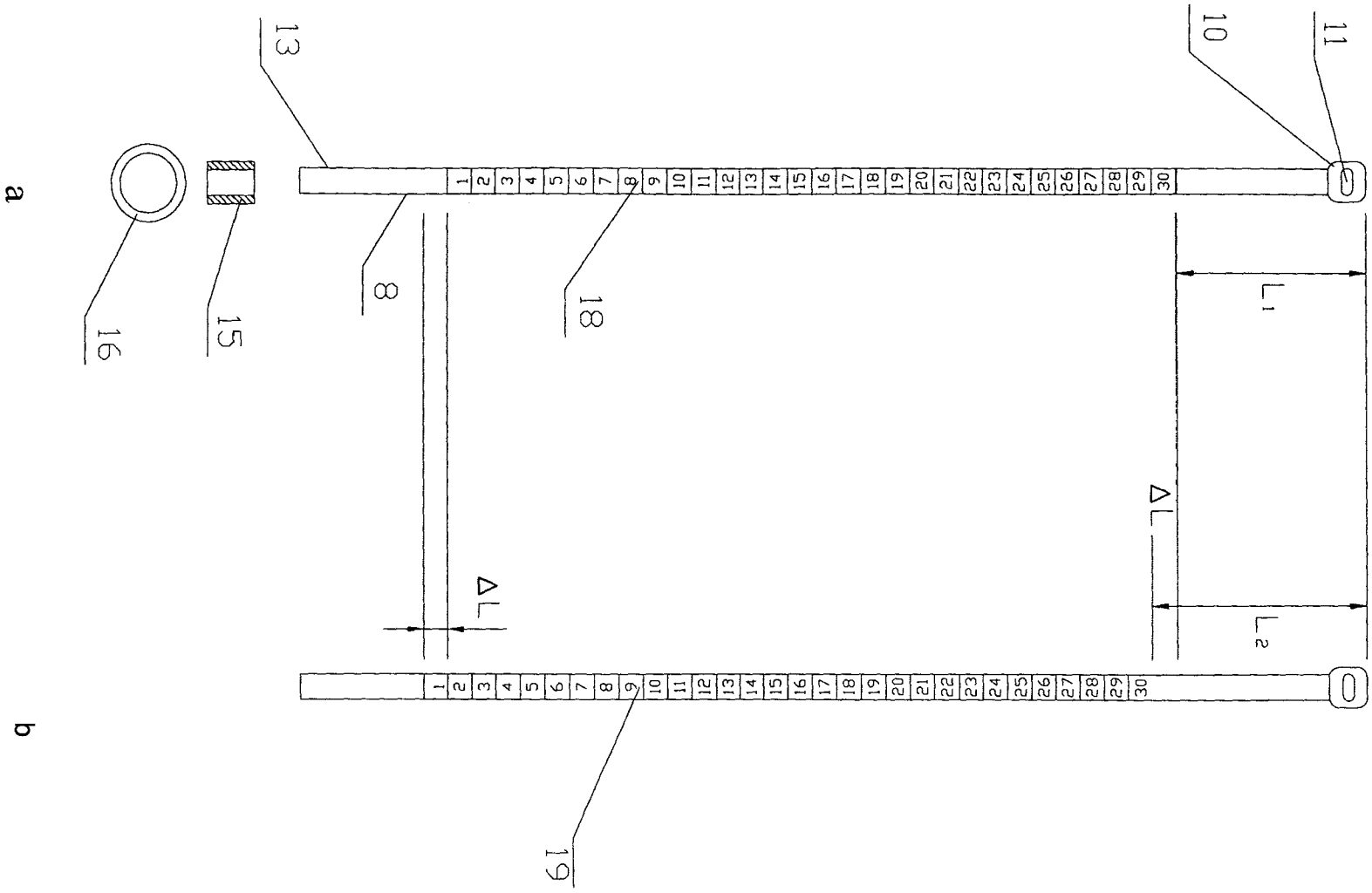
FIG. 1 shows the tie rod provided with a cartridge meter scale, the clip and the ring; a) front side, b) rear side.

The magazine (1), which is provided with the UCM (2), comprises a housing (3), a follower (4), a follower spring (5), a spring support (6), a cover (7).

The UCM (2) comprises a tie rod (8) and, in some magazine designs, an intermediate support (9) connected to the magazine follower (4).

The tie rod (8) (FIG. 1*a, b*) is made in the form of a spring-elastic band or flexible rod of a plastic, metal or composite material that allows bends not leading to its destruction or an irreversible change of its form.

Figure 2:
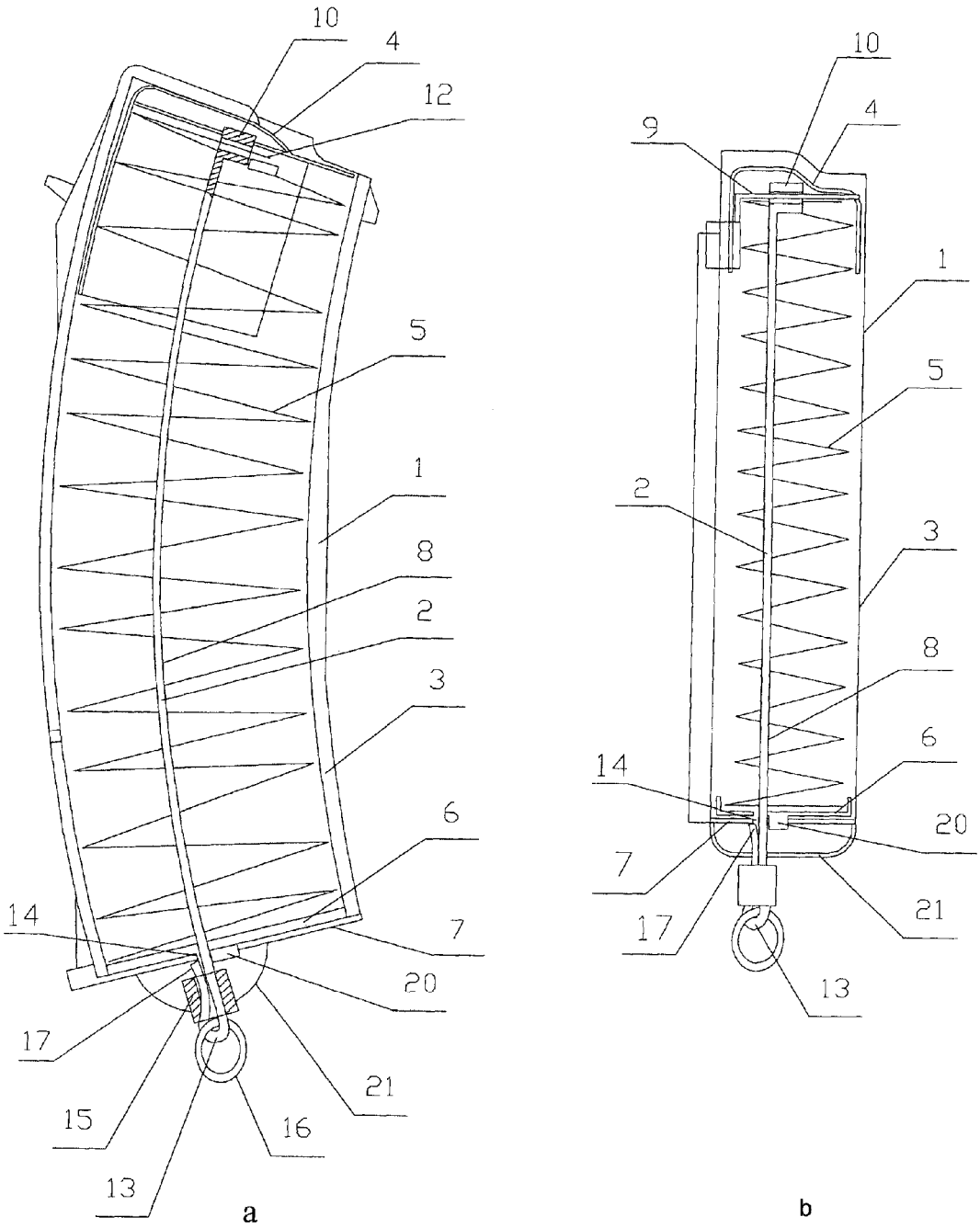
FIG. 2 shows an arms magazine without cartridges with the UCM, right-side cross-section view: a) bent, b) straight with an intermediate support.
Figure 3:
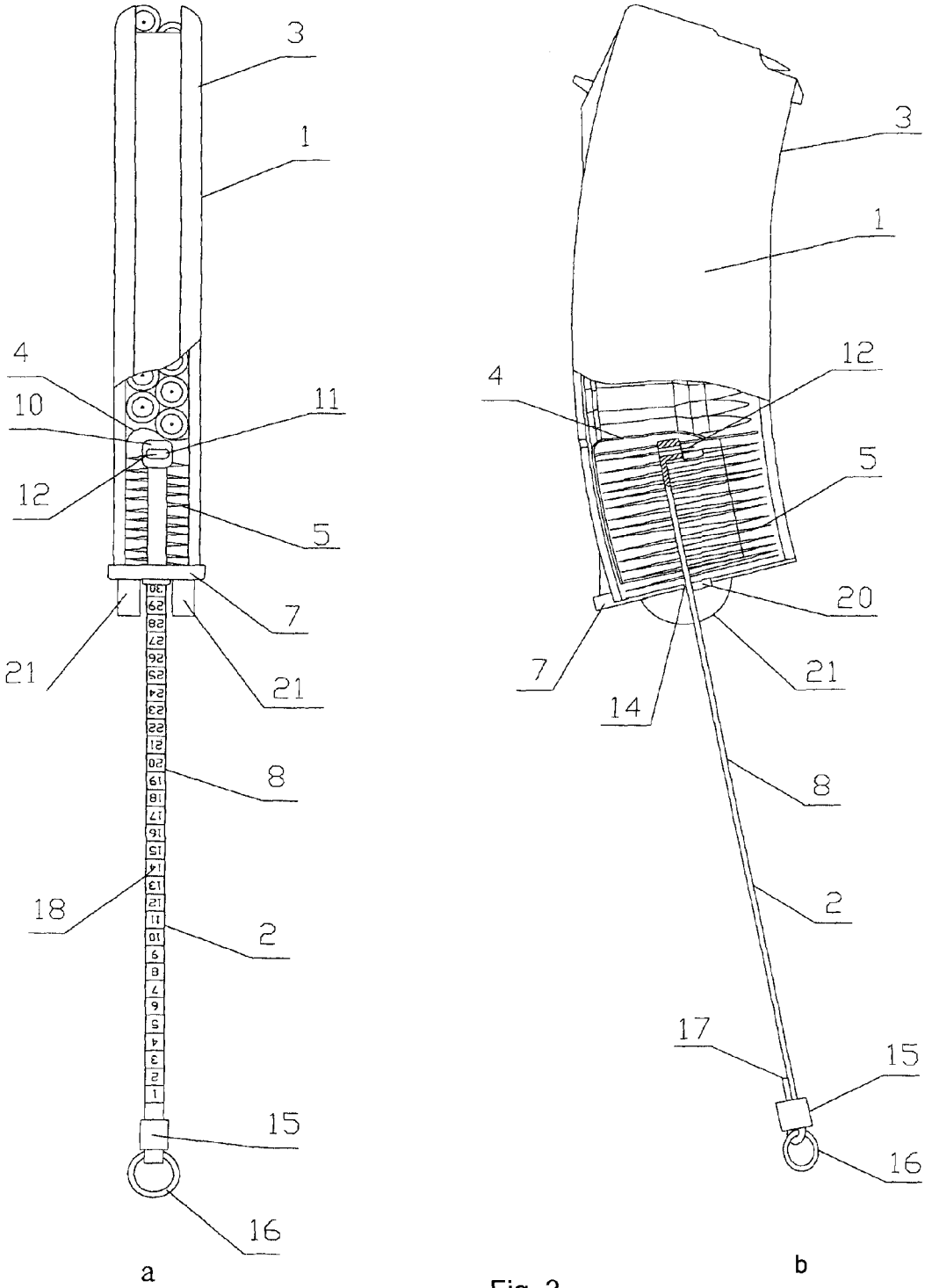
FIG. 3 shows an arms magazine charged with cartridges, with the extended tie rod of the UCM: a) front view, in partial section, b) side view, in partial section.

The upper end (10) of the tie rod is inside the magazine (1) and is connected, via a hole (11), to the upper end (12) of the spring (5), or to the follower (4), or to the intermediate support (9). In the result, the tie rod (8) turns out to be within the coils of the spring (5). The lower end (13) of the tie rod (8) goes out of the lower portion of the magazine (1) through the hole (14) between the follower spring support (6) and the cover (7) or through an additional bore made in the cover (7) and the support (6). The lower end (13) is bent by 180°, and a supporting ring (16) is attached to it in the bending point with the use of a removable collar (15). A length of the tie rod (8) is selected so as, when the magazine is empty, the bent end (17) of the tie rod (8) rests against the lower surface of the cover (7) (FIG. 2*a,b*), (FIG. 3*a,b*).

The side surfaces of the tie rod (8) are provided with scales in the form of figures contrasting with the material of the tie rod, the scales having a pitch corresponding to the pitch of charging the magazine with cartridges; the scale (18) on the front side is made with due regard to pressure exerted on a cartridge in the magazine by the arms operating slide, and the scale (19) on the rear side is made without such regard, in order to monitor a number of cartridges in the magazine separated from the arms.

The UCM can be mounted into the magazine (1) as follows. The magazine is disassembled, the upper end (10) of the tie rod (8) is put onto the end (12) of the spring (5) with the hole (11) (or is attached to the follower (4) or to the intermediate support (9)). The spring with the UCM is fixed to the follower, the tie rod (8) is inserted into the spring coils, and the spring is put into the housing (3) of the magazine. When the spring is compressed, the lower end (13) of the tie rod is passed through the holes in the support (6) and the cover (7) at the point where they are connected by a clip (20). After that the tie rod (8) is disposed within the magazine, in parallel to its walls (FIG. 2).

The end (13) of the tie rod (8) is bent by 180° so as the bend end (17) rests against the lower surface of the cover (7). Then, the collar (15) is put onto this bend for the purpose of fixing the supporting ring (16) in the place of the bend.

The UCM and the magazine can be disassembled in the reverse order.

When an empty magazine is assembled, only a small portion of the UCM with the ring (16) on the end protrudes through the hole (14) in the cover (7); and, if the ring is pressed towards the cover (7), the tie rod is not pressed into the magazine because the end (17) of the tie rod (8) rests against the cover. Meanwhile, no figure can be seen on the cartridge scales (18) and (19) on the tie rod (8) either on the front surface, or on the rear surface.

The lower surface of the cover (7) may be provided with protective protrusions (21) that preclude sharp bend or braking of the tie rod (8), when the magazine rests against a solid surface during shooting.

The proposed device can be operated as follows. In order to charge a magazine with cartridges, the magazine is held by the left hand, the supporting ring (16) is put onto any suitable hook, e.g., a driven-in nail, a twig, a clincher on clothes or outfit, the gun butt clip is inserted into the aperture in the arms bolt support and fixed by the safety catch bracket, etc.

While pulling the tie rod (8) by the magazine with the left hand, the spring (5) is compressed gradually. Cartridges are inserted or poured into a space left by the follower (4) from a box, while gradually pulling the tie rod (8) out of the magazine, until the follower (4) rests against the support (6) of the magazine spring (5). Thus, a magazine may be charged with cartridges easily and quickly.

In order to monitor the process of charging the magazine, it is sufficient to look at the scale (19) applied to the rear surface of the tie rod (8), which goes out of the magazine.

In order to unload a magazine, it is held by one hand in the horizontal position, while its neck is directed into a receiving container (a hat, a box), and the other hand pulls the supporting ring (16) of the tie rod (8) reciprocally. Meanwhile, cartridges are easily discharged into the receiving container.

During shooting, the availability of cartridges in the magazine may be monitored both by visual and tactile methods.

When a magazine provided with the UCM is inserted into arms, cartridges are additionally sunk into the magazine, when interacting with the operating slide. Meanwhile, the scales on the tie rod (8) are moved down by the distance $\Delta L$ (FIG. 1), and a correct number of cartridges can be determined at the scale (18) on the front portion of the tie rod (8).

A number of cartridges in a magazine mounted onto arms may be determined visually by turning the arms sideways and looking at a scale figure visible above the surface of the magazine cover (7).

In the dark or in conditions, when there is no possibility of diverting attention from aiming, the availability of cartridges in the magazine can be determined by touch, according to a length of a [portion of the tie rod (8) protruding from the magazine.

When cartridges are spent nearly in full, i.e., when 1-2 cartridges are left in the magazine, their availability can be determined by touch, by way of pressing the ring towards the magazine cover (7) with a hand. If the tie rod (8) may be sunk into the magazine slightly, it means that a cartridge is still available. If the bent end (17) of the tie rod (8) rests against the cover (7), and the tie rod cannot be pressed into the magazine, it means that there are no cartridges in the magazine; there is no necessity of looking at the scale (18).

Magazines with the UCM, after being charged with cartridges, are put into standard pouches. Meanwhile, the tie rod (8) is bent over the corners of the magazine cover (7) and does not interfere with transportation of charged magazines.

The technical effect of the proposed invention is the development of a simple and reliable universal charging device and meter of cartridges in box magazines, which enables to load/unload cartridges quickly and monitor their number in box magazines both removed from and inserted into arms by visual and tactile methods.

The device has a minimum weight and may be easily introduced into any box magazine for an assault rifle or a gun having a springy follower.

What is claimed is:

1. A magazine device for universal charging and metering, the device comprising:

a housing;

a follower;

a follower spring having an upper spring end;

an intermediate support between said follower and said follower spring;

a cover;

a spring-elastic tie rod being constructed from one material of a group consisting of plastic, metal and composite and having an upper end and a lower end, wherein said tie rod having a first face on a first side with a first numbered scale and a second face on a second side with a second numbered scale, said first numbered scale and said second numbered scale correspond to a number of cartridges, wherein said upper end connects to at least one of a group consisting of said follower, said upper spring end, and said intermediate support, said upper end being located inside said housing, wherein said lower end is comprised of a bend end formed by the tie rod folded back over itself so as to form a 180 degree bend in the tie rod;

a collar affixed around said bend end so as to define said 180 degree bend; and a supporting ring passed through said 180 degree bend, wherein said lower end passes through a hole in said cover, said collar and said support ring being outside said cover, wherein the tie rod has a first position corresponding to said follower spring in a compressed condition and a second position corresponding to said follower spring in a tensioned condition, the tie rod being moveable between said first position and said second position according to said number of cartridges, wherein said bend end is adjacent an end surface of said cover in said second position, and wherein said cover has a plurality of protective protrusions around said hole, said protrusions extending outwardly of said end surface.

2. The magazine device for universal charging and metering, according to claim 1, wherein said protective protrusions face each other across opposite sides of said hole.

3. A magazine device for universal charging and metering, the device comprising:

a housing;

a follower;

a follower spring having an upper spring end;

an intermediate support between said follower and said follower spring;

a cover;

a spring-elastic tie rod being constructed from one material of a group consisting of plastic, metal and composite and having an upper end and a lower end, wherein said tie rod having a first face on a first side with a first scale and a second face on a second side with a second scale, said first scale and said second scale correspond to a number of cartridges, wherein said upper end connects to at least one of a group consisting of said follower, said upper spring end, and said intermediate support, said upper end being located inside said housing, wherein said lower end is comprised of a bend end formed by the tie rod folded back over itself so as to form a 180 degree bend in the tie rod;

a collar affixed around said bend end so as to define said 180 degree bend; and a supporting ring passed through said 180 degree bend, wherein said lower end passes through a hole in said cover, said collar and said support ring being outside said cover, wherein the tie rod has a first position corresponding to said follower spring in a compressed condition and a second position corresponding to said follower spring in a tensioned condition, the tie rod being moveable between said first position and said second position according to said number of cartridges, wherein said bend end is adjacent an end surface of said cover in said second position, and wherein said cover has a plurality of protective protrusions around said hole, said protrusions extending outwardly of said end surface.

* * * * *